US011036176B2

(12) United States Patent
Fukamachi et al.

(10) Patent No.: US 11,036,176 B2
(45) Date of Patent: Jun. 15, 2021

(54) IMAGE FORMING APPARATUS

(71) Applicant: BROTHER KOGYO KABUSHIKI KAISHA, Nagoya (JP)

(72) Inventors: Yasuo Fukamachi, Nagoya (JP); Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/998,325

(22) Filed: Aug. 20, 2020

(65) Prior Publication Data

US 2021/0063948 A1 Mar. 4, 2021

(30) Foreign Application Priority Data

Sep. 2, 2019 (JP) ..... JP2019-159886

(51) Int. Cl.
*G03G 15/00* (2006.01)
*G03G 21/16* (2006.01)

(52) U.S. Cl.
CPC ..... *G03G 21/1647* (2013.01); *G03G 21/1661* (2013.01)

(58) Field of Classification Search
CPC ..... G03G 21/1613; G03G 21/1633; G03G 21/1647; G03G 21/1661; G03G 21/1684; G03G 21/1842; G03G 2221/1654
USPC ..... 399/107, 110, 117, 125
See application file for complete search history.

(56) References Cited

U.S. PATENT DOCUMENTS

| | | | | |
|---|---|---|---|---|
| 8,145,095 | B2 * | 3/2012 | Sakurai | G03G 21/16 399/110 |
| 9,310,758 | B2 * | 4/2016 | Oba | G03G 21/1647 |
| 9,720,345 | B2 * | 8/2017 | Tanaami | G03G 21/1666 |
| 2010/0054800 | A1 | 3/2010 | Okabe | |
| 2011/0026966 | A1 | 2/2011 | Ushiozu | |
| 2016/0154374 | A1 | 6/2016 | Hiramatsu et al. | |
| 2016/0154375 | A1 | 6/2016 | Kamizato et al. | |

FOREIGN PATENT DOCUMENTS

| | | | |
|---|---|---|---|
| JP | 2010-054837 | A | 3/2010 |
| JP | 2011-048347 | A | 3/2011 |
| JP | 2016-102987 | A | 6/2016 |
| JP | 2016-110133 | A | 6/2016 |

* cited by examiner

*Primary Examiner* — Hoan H Tran
(74) *Attorney, Agent, or Firm* — Merchant & Gould P.C.

(57) ABSTRACT

An image forming apparatus, having a housing, a drawer, and a cartridge, is provided. The drawer is movable between an inner position and an outer position. The cartridge includes a photosensitive drum and a drum cover. The photosensitive drum is rotatable about an axis extending in a first direction. The drum cover is movable with respect to the photosensitive drum between a first position and a second position. The drawer includes a guide, a stopper, and a contacting portion. The guide guides the cartridge in a second direction, when the cartridge is being attached to the drawer. The stopper stops the cartridge from separating from the guide in a third direction. The contacting portion contacts the drum cover and move the drum cover from the first position to the second position in a state where the cartridge is being guided by the guide.

14 Claims, 7 Drawing Sheets

IMAGE FORMING APPARATUS

CROSS REFERENCE TO RELATED APPLICATION

This application claims priority under 35 U.S.C. § 119 from Japanese Patent Application No. 2019-159886, filed on Sep. 2, 2019, the entire subject matter of which is incorporated herein by reference.

BACKGROUND

Technical Field

The following description is related to an image forming apparatus.

Related Art

Image forming apparatus having a housing, a drawer, and a cartridge containing a photosensitive drum, is known. The drawer may be movable between an inner position, in which the drawer is located inside the housing, and an outer position, in which the drawer is located outside the housing. The cartridge may be detachably attached to the drawer to move along with the drawer.

SUMMARY

While the cartridge is detachable from the image forming apparatus, a user may wish to protect the photosensitive drum in the cartridge when the cartridge is detached from the image forming apparatus.

The present disclosure is advantageous in that an image forming apparatus having a cartridge, which is detachable and in which a photosensitive drum may be protected while the cartridge is detached from the image forming apparatus, is provided.

According to an aspect of the present disclosure, an image forming apparatus, having a housing, a drawer, and a cartridge, is provided. The drawer is movable between an inner position, in which the drawer is located inside the housing, and an outer position, in which the drawer is located outside the housing. The cartridge is attachable to the drawer. The cartridge includes a photosensitive drum and a drum cover. The photosensitive drum is rotatable about an axis extending in a first direction. The drum cover is movable with respect to the photosensitive drum between a first position, in which the drum cover covers a part of the photosensitive drum, and a second position, in which the part of the photosensitive drum is exposed. The drawer includes a guide, a stopper, and a contacting portion. The guide is configured to guide the cartridge in a second direction, when the cartridge is being attached to the drawer. The second direction intersects with the first direction. The stopper is configured to, in a state where the cartridge is being guided by the guide, stop the cartridge from separating from the guide in a third direction. The third direction intersects with the first direction and with the second direction. The contacting portion is configured to contact the drum cover and move the drum cover from the first position to the second position in the state where the cartridge is being guided by the guide.

BRIEF DESCRIPTION OF THE ACCOMPANYING DRAWINGS

DETAILED DESCRIPTION

Hereinafter, with reference to the accompanying drawings, an embodiment according to an aspect of the present disclosure will be described in detail.

1. Overall Configuration of Image Forming Apparatus 1

In the paragraphs below, described with reference to FIGS. 1 and 2 will be an overall configuration of an image forming apparatus 1.

Figure 1:
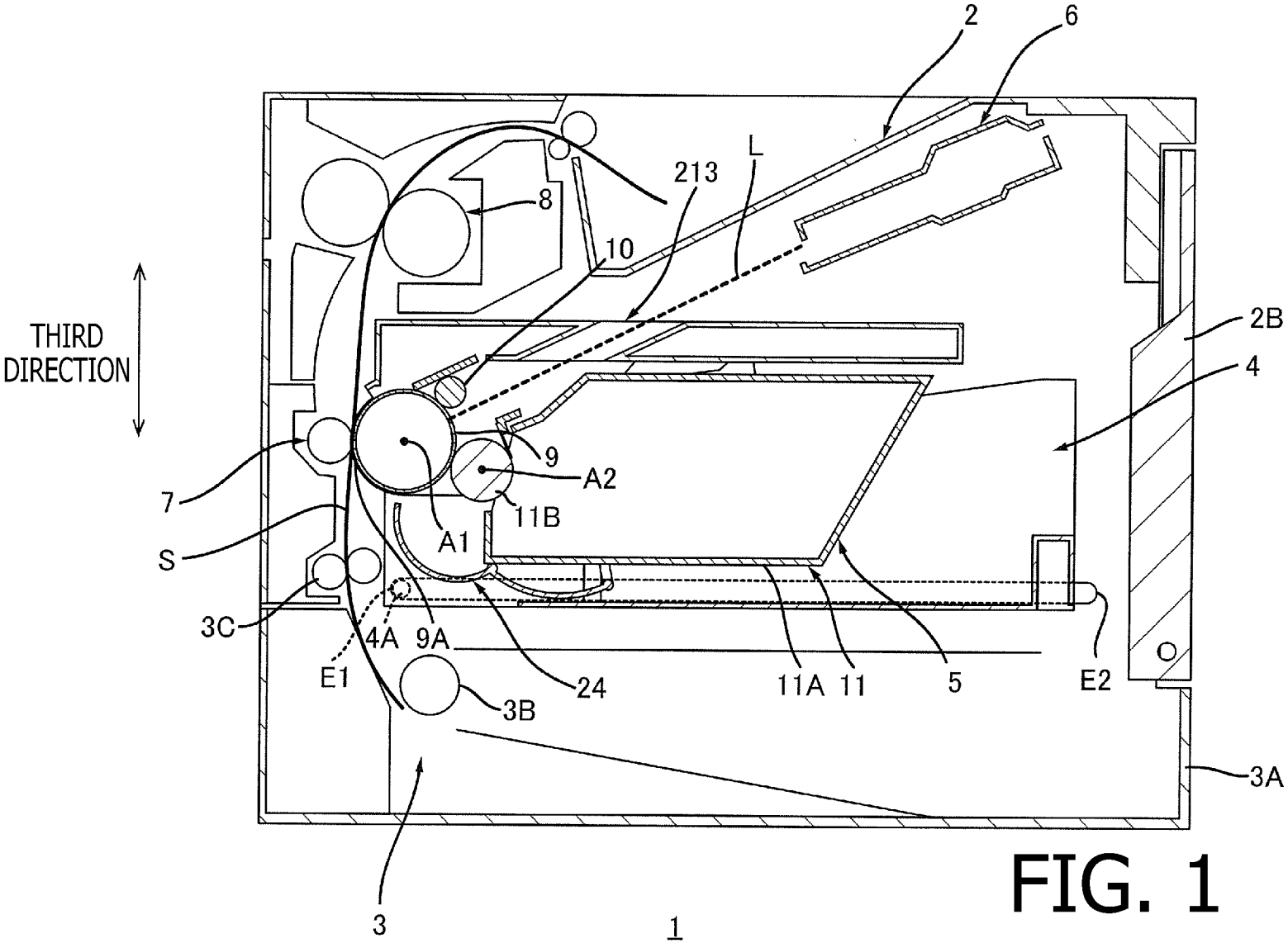
FIG. 1 is a cross-sectional overall view of an image forming apparatus according to an embodiment of the present disclosure.

As shown in FIG. 1, the image forming apparatus 1 includes a housing 2, a sheet feeder 3, a drawer 4, a cartridge 5, an exposure devise 6, a transfer roller 7, and a fuser 8. The image forming apparatus 1 may be a monochrome printing apparatus having a single cartridge 5 for printing an image in a single color.

1.1 Housing 2

The housing 2 accommodates the sheet feeder 3, the drawer 4, the cartridge 5, the exposure device 6, the transfer roller 7, and the fuser 8. The housing 2 has an opening 2A as shown in FIG. 2. The housing 2 includes a cover 2B.

Figure 2:
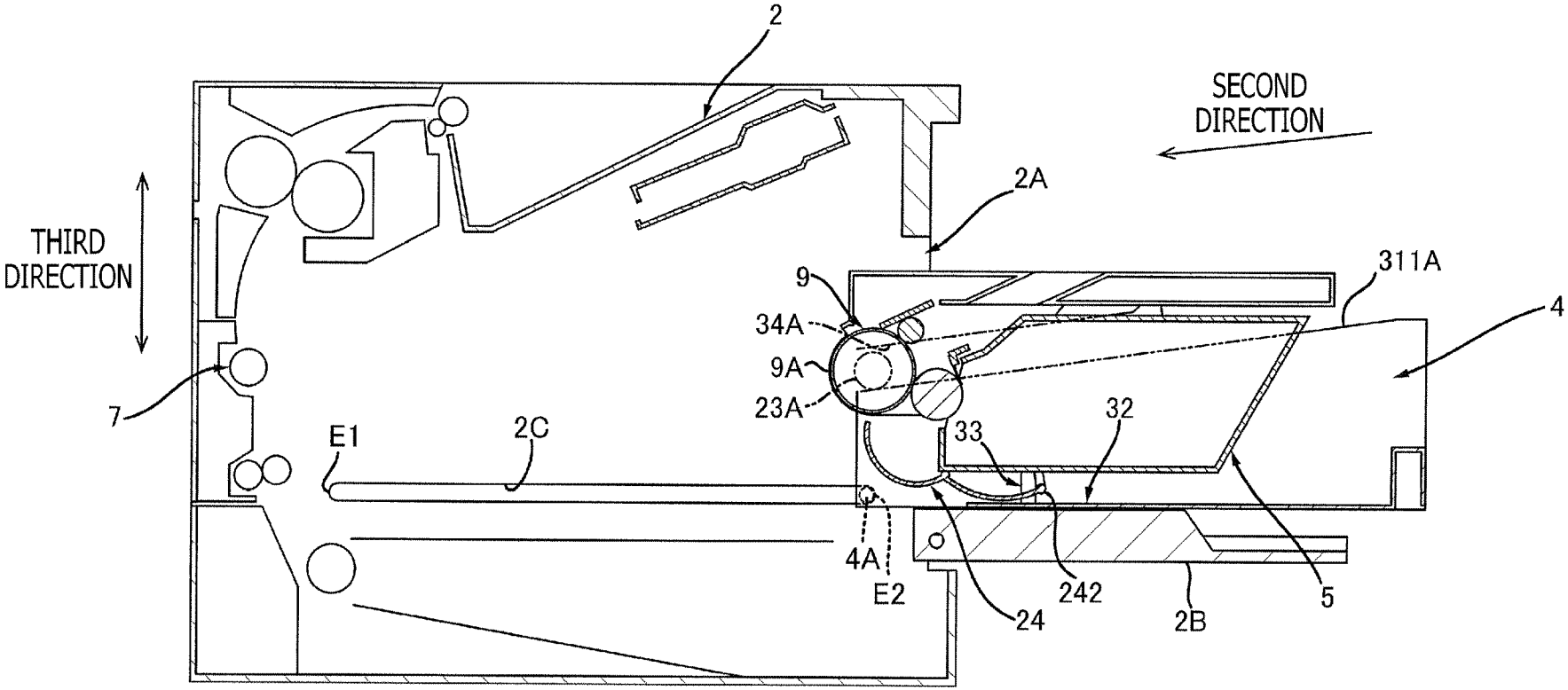
FIG. 2 is a cross-sectional view of the image forming apparatus according to the embodiment of the present disclosure with a drawer located at an outer position.

As shown in FIGS. 1 and 2, the cover 2B is movable between a closure position (see FIG. 1) and an open position (see FIG. 2). The cover 2B, when located at the closure position, closes the opening 2A and, when located at the open position, exposes the opening 2A.

1.2 Sheet Feeder 3

As shown in FIG. 1, the sheet feeder 3 may feed a sheet S to a photosensitive drum 9, which will be described further below. The sheet feeder 3 includes a sheet cassette 3A, a pickup roller 3B, and a conveyer roller 3C.

The sheet cassette 3A may accommodate one or more sheets S. The pickup roller 3B may pick up one of the sheets S from the sheet cassette 3A and convey the picked-up sheet S to the conveyer roller 3A. The conveyer roller 3C may convey the sheet S conveyed by the pickup roller 3B to the photosensitive drum 9.

1.3 Drawer 4

The drawer 4 is movable between an inner position (see FIG. 1) and an outer position (see FIG. 2) through the opening 2A in a state where the cover 2B is at the open position as shown in FIG. 2. The movable direction for the drawer 4 to move between the inner position and the outer position intersects with a vertical direction. On the drawer 4, the cartridge 5 is mountable. The drawer 4 may move between the inner position and the outer position with the cartridge 5 mounted thereon.

The housing 2 has a guide 2C (see FIG. 2), and the drawer 4 has a guided portion 4A, which may fit in the guide 2C. The guided portion 4A may be, for example, a wheel. For another example, the guided portion 4A may be a protrusion in a cylindrical shape. The guide 2C may guide the guided portion 4A there-along. The guide 2C extends in the movable direction for the drawer 4. The guide 2C has a first end E1 and a second end E2. The second end E2 is located apart from the first end E1 in the movable direction for the drawer 4. The second end E2 is located between the cover 2B located at the closure position and the first end E1 in the movable direction for the drawer 4.

As shown in FIG. 1, the inner position may be a position, in which the guided portion 4A of the drawer 4 fits with the first end E1 of the guide 2C. In a state where the drawer 4 is located at the inner position, the drawer 4 is entirely located inside the housing 2.

As shown in FIG. 2, the outer position may be a position, in which the guided portion 4A of the drawer 4 fits with the second end E2 of the guide 2C. In a state where the drawer 4 is located at the outer position, the drawer 4 is at least partly located outside the housing 2.

1.4 Cartridge 5

As shown in FIG. 2, in the state where the drawer 4 is located at the outer position, the cartridge 5 may be attached to the drawer 4. In the context of the present disclosure, a state where the cartridge 5 is attached to the drawer 4 may equal a state where the cartridge 5 is mounted at a predetermined position on the drawer 4. In the state where the cartridge 5 is attached to the drawer 4, the cartridge 5 may or may not be fixed to the drawer 4.

As shown in FIG. 1, the cartridge 5 includes the photosensitive drum 9, a charger roller 10, and a developing device 11.

1.4.1 Photosensitive Drum 9

The photosensitive drum 9 is rotatable about an axis A1. The axis A1 extends in a first direction, which intersects with the movable direction for the drawer 4 and with the vertical direction. Preferably, the first direction may intersect orthogonally with the movable direction for the drawer 4 and with the vertical direction. The photosensitive drum 9 extends in the first direction and has a cylindrical shape.

1.4.2 Charger Roller 10

The charger roller 10 may charge a surface of the photosensitive drum 9. The charger roller 10 is arranged to contact the surface of the photosensitive drum 9. Optionally, the cartridge 5 may have a scorotron-typed charging device in place of the charger roller 10.

1.4.3 Developing Device 11

The developing device 11 may supply toner to the photosensitive drum 9. The developing device 11 includes a developer housing 11A and a developer roller 11B. In other words, the cartridge 5 includes the developer housing 11A and the developer roller 11B.

The developer housing 11A may store the toner to be supplied to the photosensitive drum 9. The developer housing 11A supports the developer roller 11B.

The developer roller 11B is rotatable about an axis A2, which extends in the first direction. The developer roller 11B is arranged to contact the photosensitive drum 9. The developer roller 11B may supply the toner in the developer housing 11A to the photosensitive drum 9.

1.5 Exposure Device 6

In the state where the cartridge 5 is attached to the drawer 4 and where the drawer 4 is located at the inner position, the exposure device 6 may expose the surface of the photosensitive drum 9. For example, the exposure device 6 may be a laser scanner. The exposure device 6 may emit a laser beam L at the photosensitive drum 9.

When the surface of the photosensitive drum 9 is charged by the charger roller 10, the exposure device 6 may expose the surface of the photosensitive drum 9 to the laser beam L to form an electrostatic latent image on the surface of the photosensitive drum 9.

1.6 Transfer Roller 7

The transfer roller 7 is arranged to, in the state where the cartridge 5 is attached to the drawer 4 and where the drawer 4 is located at the inner position, contact the photosensitive drum 9. Meanwhile, the sheet S conveyed by the conveyer roller 3C may enter a position between the transfer roller 7 and the photosensitive drum 9. As the sheet S passes between the transfer roller 7 and the photosensitive drum 9, the transfer roller 7 may transfer a toner image formed on the surface of the photosensitive drum 9 to the sheet S.

1.7 Fuser 8

The fuser 8 may apply heat and pressure to the sheet S having the transferred toner image to fuse and fix the toner image on the sheet S. The sheet S exiting the fuser 8 may be discharged outside the housing 2.

2. Detailed Configuration of the Cartridge

Next, with reference to FIGS. 1-4, the cartridge 5 will be described in detail.

The cartridge 5 includes, further to the photosensitive drum 9, the charger roller 10, and the developing device 11 described above, a frame 21 (see FIG. 3A), a guided portion 23A (see FIG. 4), a guided portion 23B (see FIG. 4), a drum cover 24 (see FIG. 3A), and a torsion spring 25 (see FIG. 3A).

2.1 Frame 21

Figure 3A:
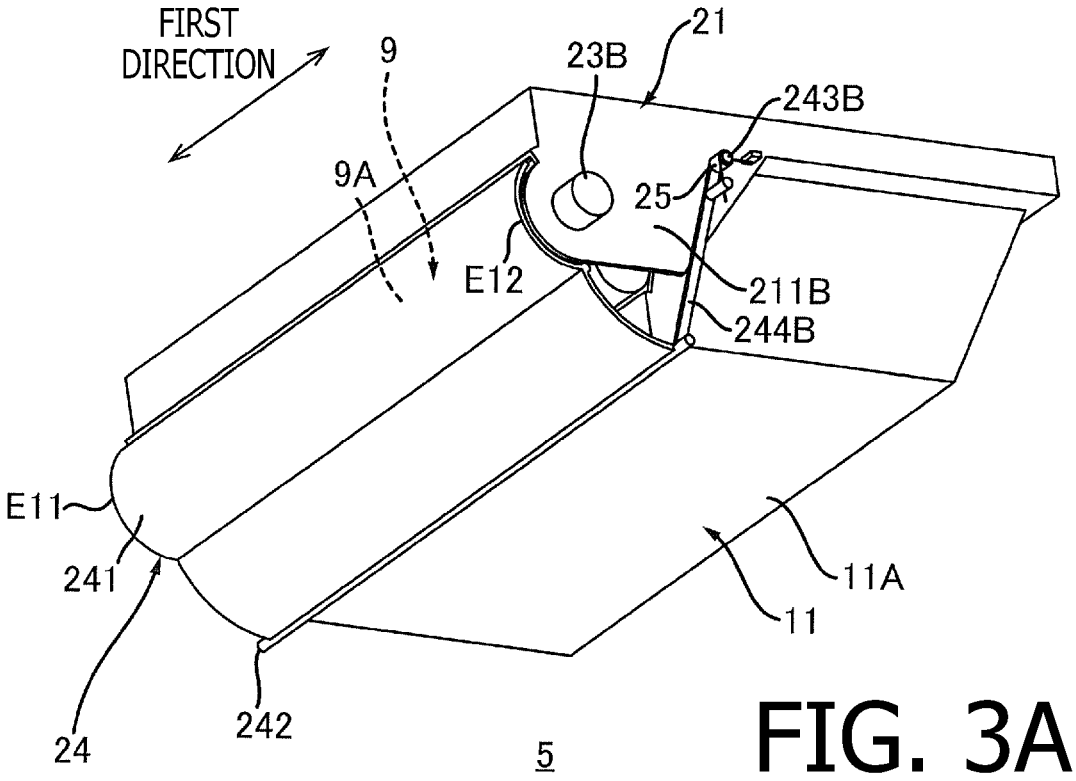
FIG. 3A is a perspective view of a cartridge of the image forming apparatus according to the embodiment of the present disclosure with a drum cover located at a first position.

As shown in FIG. 3A, the frame 21 supports the photosensitive drum 9, the charger roller 10 (see FIG. 1), the developing device 11, and the drum cover 24.

Figure 4:
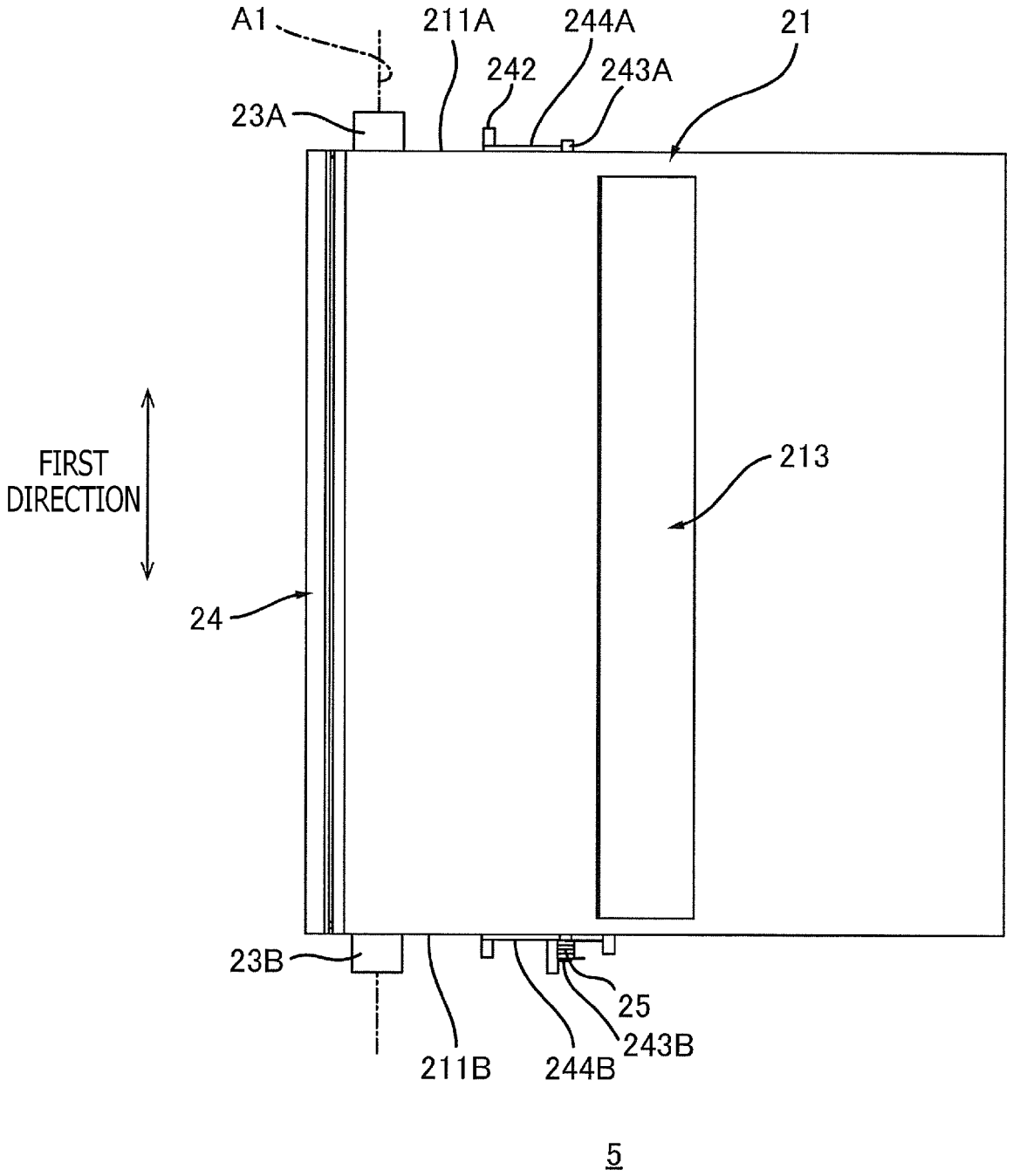
FIG. 4 is a plan view of the cartridge according to the embodiment of the present disclosure.

As shown in FIG. 4, the frame 21 extends in the first direction. The frame 21 has a first end and a second end, which are on one end and the other end in the first direction. The second end is located apart from the first end in the first direction. The frame 21 includes a side plate 211A and a side plate 211B. The frame 21 has a through hole 213.

2.1.1 Side Plate 211A

The side plate 211A is located at the first end of the frame 21. The side plate 211A extends in a direction intersecting with the axis A1. Preferably, the side plate 211A may extend in a direction intersecting orthogonally with the axis A1.

2.1.2 Side Plate 211B

The side plate 211B is located apart from the side plate 211A in the first direction. The side plate 211B is located at the second end of the frame 21. The form of the side plate 211B may be described in the same manner as the side plate 211A.

2.1.3 Through Hole 213

The through hole 213 is located between the side plate 211A and the side plate 211B in the first direction. As shown in FIG. 1, in the state where the cartridge 5 is attached to the drawer 4 and where the drawer 4 is located at the inner position, the laser beam L emitted from the exposure device 6 may transmit through the through hole 213 and reach the surface of the photosensitive drum 9.

2.2 Guided Portion 23A

As shown in FIG. 4, the guided portion 23A is located on a side of the side plate 211A opposite to the side plate 211B in the first direction. The guided portion 23A extends to protrude from the side plate 211A in the first direction. In other words, the guided portion 23A is a protrusion. Optionally, the guided portion 23A may be attached to the side plate 211A. The guided portion 23A extends in the first direction along the axis A1. The guided portion 23A may have a cylindrical shape. Optionally, the guided portion 23A may support an end of the photosensitive drum 9 therein. The guided portion 23A may be guided by a guide 311A (see FIG. 5) on the drawer 4 when the cartridge 5 is being attached to the drawer 4.

2.3 Guided Portion 23B

The guided portion 23B is located on a side of the side plate 211B opposite to the side plate 211A in the first direction. The guided portion 23B is located apart from the guided portion 23A in the first direction. The guided portion 23B extends from the side plate 211B. Optionally, the guided portion 23B may be attached to the side plate 211B. The form of guided portion 23B may be described in the same manner as the guided portion 23A.

2.4 Drum Cover 24

Figure 3B:
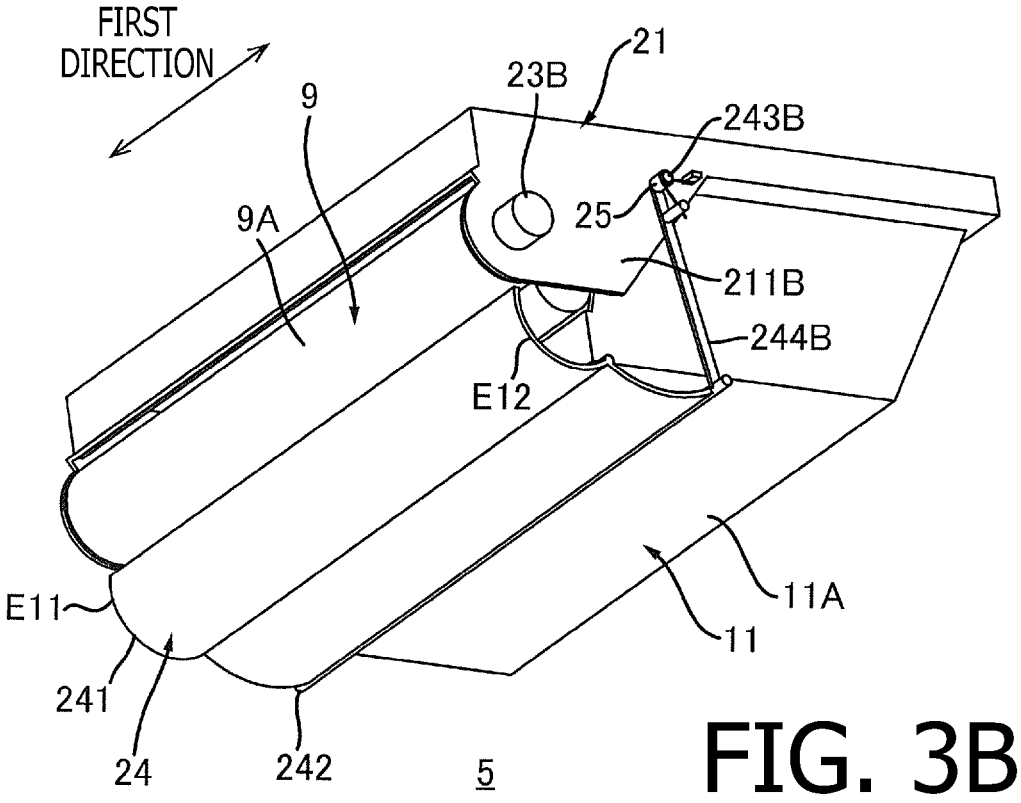
FIG. 3B is a perspective view of the cartridge of the image forming apparatus according to the embodiment of the present disclosure with the drum cover located at a second position.

As shown in FIGS. 3A-3B, the drum cover 24 is movable with respect to the photosensitive drum 9 between a first position (see FIG. 3A) and a second position (see FIG. 3B).

As shown in FIG. 3A, the drum cover 24 may be located at the first position in a state where the cartridge 5 is detached from the drawer 4. In the state where the drum cover 24 is located at the first position, the drum cover 24 covers a part 9A of the photosensitive drum 9. In this arrangement, the drum cover 24 may protect the photosensitive drum 9 when the cartridge 5 is removed from the drawer 4.

On the other hand, as shown in FIG. 2, the drum cover 24 may be located at the second position in the state where the cartridge 5 is attached to the drawer 4. In the state where the drum cover 24 is located at the second position, the part 9A of the drum cover 9 may be uncovered. The photosensitive drum 9 may be located inside the housing 2 with the part 9A being exposed. While the drum cover 24 is located at the second position, and even though the part 9A of the photosensitive drum 9 is exposed, the exposed part 9A of the photosensitive drum 9 may be protected by the housing 2. In the state where the cartridge 5 is attached to the drawer 4 and where the drawer 4 is located at the inner position (see FIG. 1), the part 9A of the photosensitive drum 9 may contact the transfer roller 7.

In the state where the cartridge 5 is attached to the drawer 4, the drum cover 24 located at the second position is located below the photosensitive drum 9. Moreover, in the state where the cartridge 5 is attached to the drawer 4, the drum cover 24 located at the second position is located between the cartridge 5 and the bottom plate 32. Thus, by use of a space between the bottom plate 32 of the drawer 4 and the photosensitive drum 9, the part of the drum cover 24 may be located at the second position. Therefore, a volume of the image forming apparatus 1 may be restrained from increasing. The bottom plate 32 will be described further below.

As shown in FIG. 3A, the drum cover 24 includes a cover body 241, a protrusion 242, a shaft 243A (see FIG. 4), a shaft 243B, an arm 244A (see FIG. 4), and an arm 244B.

2.4.1 Cover body 241

The cover body 241 extends in the first direction. The cover body 241 may be a plate. The cover body 241 is arranged along the surface of the photosensitive drum 9 and has a cross-sectional shape of an arc. The cover body 241 has a first end portion E11 and a second end portion E12, which are on one end and the other end in the first direction. The second end portion E12 is located apart from the first end portion E11 in the first direction.

2.4.2 Protrusion 242

The protrusion 242 is located at the first end portion E11 of the cover body 241 in the first direction. The protrusion 242 may contact a contacting portion 33 of the drawer 4 when the cartridge 5 is being attached to the drawer 4 (see FIG. 7). Moreover, the protrusion 242 may contact the contacting portion 33 of the drawer 4 in the state where the cartridge 5 is attached to the drawer 4 (see FIG. 2). The contacting portion 33 will be described further below.

2.4.3 Shaft 243A

The shaft 243A is located on a side of the side plate 211A opposite to the side plate 211B in the first direction. The shaft 243A is attached to the side plate 211A. The shaft 243A is rotatable with respect to the frame 21. The shaft 243A extends in the first direction. The shaft 243A has a cylindrical shape.

2.4.4 Shaft 243B

The shaft 243B is located on a side of the side plate 211B opposite to the side plate 211A in the first direction. The shaft 243B is attached to the side plate 211B. The form of the shaft 243B may be described in the same manner as the shaft 243A.

2.4.5 Arm 244A

The arm 244A is located on the side of the side plate 211A opposite to the side plate 211B in the first direction. The arm 244A extends in a direction intersecting with the first direction. Preferably, the arm 244A may extend in a direction intersecting orthogonally with the first direction. The arm 244A has a first end and a second end. The first end and the second end of the arm 244A are on one end and the other end in the direction, in which the arm 244A extends. At the first end thereof, the arm 244A is connected to the shaft 243A, and at the second end thereof, the arm 244A is connected to the first end portion E11 (see FIG. 3A) of the arm body 241.

2.4.6 Arm 244B

The arm 244B is located on the side of the side plate 211B opposite to the side plate 211A in the first direction. The form of the arm 244B may be described in the same manner as the arm 244A. At a first end thereof, the arm 244B is connected to the shaft 243B, and at a second end thereof, the arm 244B is connected to the second end portion E12 (see FIG. 3A) of the arm body 241.

2.5 Torsion Spring 25

The torsion spring 25 may urge the drum cover 24 located at the second position (see FIG. 3B) toward the first position (see FIG. 3A). One end of the torsion spring 25 is attached to the side plate 211B of the frame 21, and the other end of the torsion spring 25 is attached to the arm 244B of the drum cover 24.

3. Detailed Configuration of Drawer 4

Next, the drawer 4 will be described in detail with reference to FIGS. 2, 5, 6, and 7.

Figure 5:
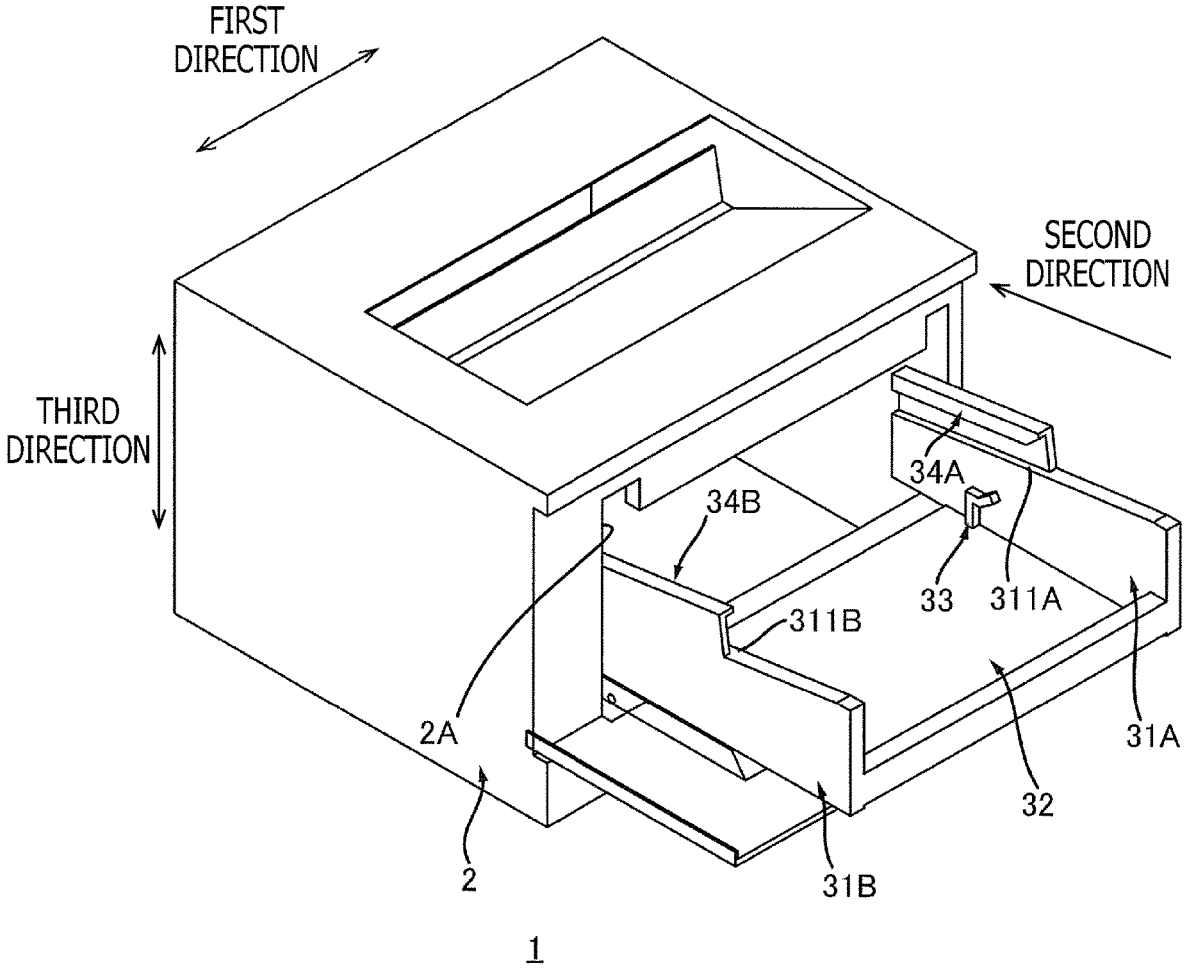
FIG. 5 is a perspective view of the image forming apparatus according to the embodiment of the present disclosure, in which the cartridge is removed from the drawer.

As shown in FIG. 5, the drawer 4 includes a first side plate 31A, a second side plate 31B, the bottom plate 32, the contacting portion 33, a stopper 34A, and a stopper 34B.

3.1 First Side Plate 31A

The first side plate 31A extends in the movable direction for the drawer 4. The first side plate 31A includes a guide 311A. In other words, the drawer 4 includes the guide 311A.

Figure 6:
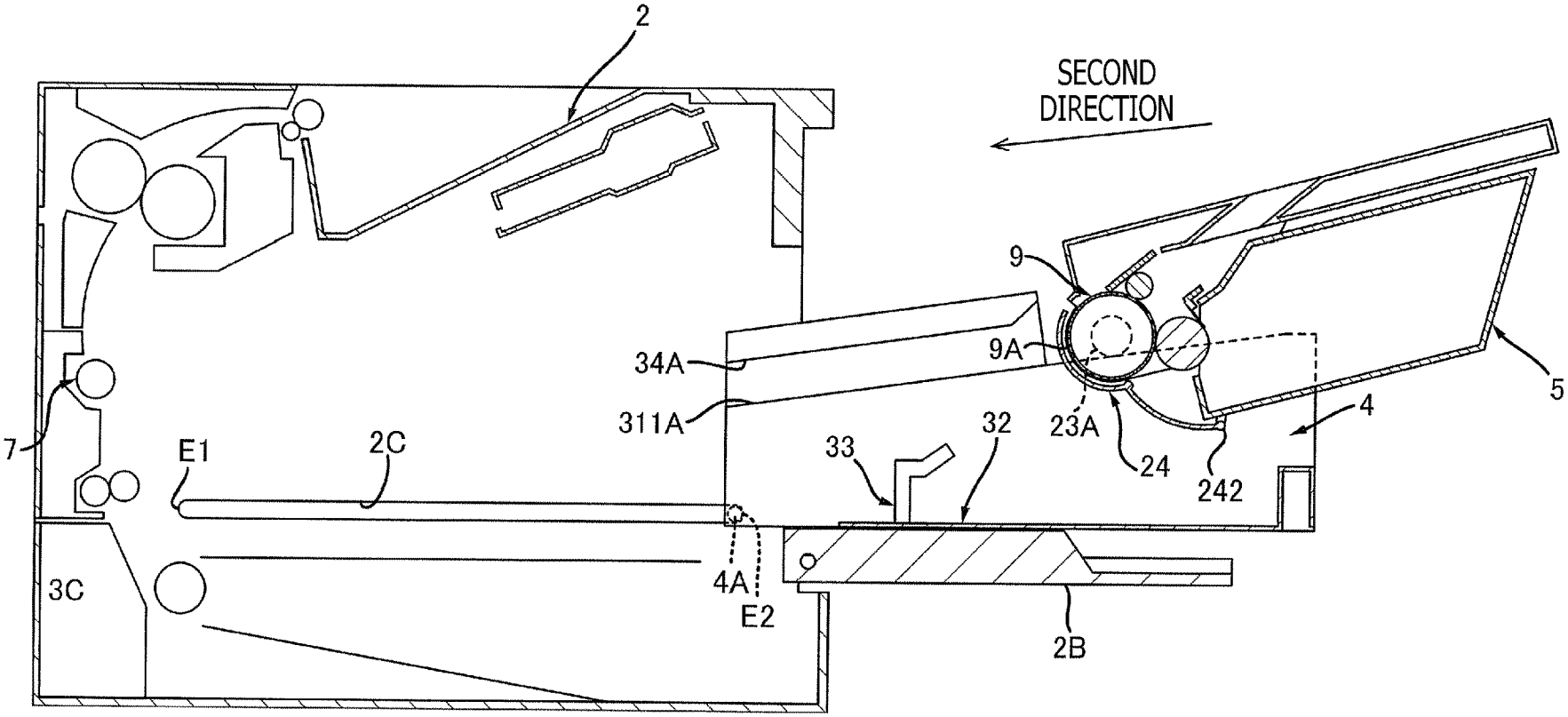
FIG. 6 is an illustrative view of the cartridge attached to the drawer with a protrusion on the drum cover separated from a contacting portion, in a state where the drum cover is located at the first position, according to the embodiment of the present disclosure.
Figure 7:
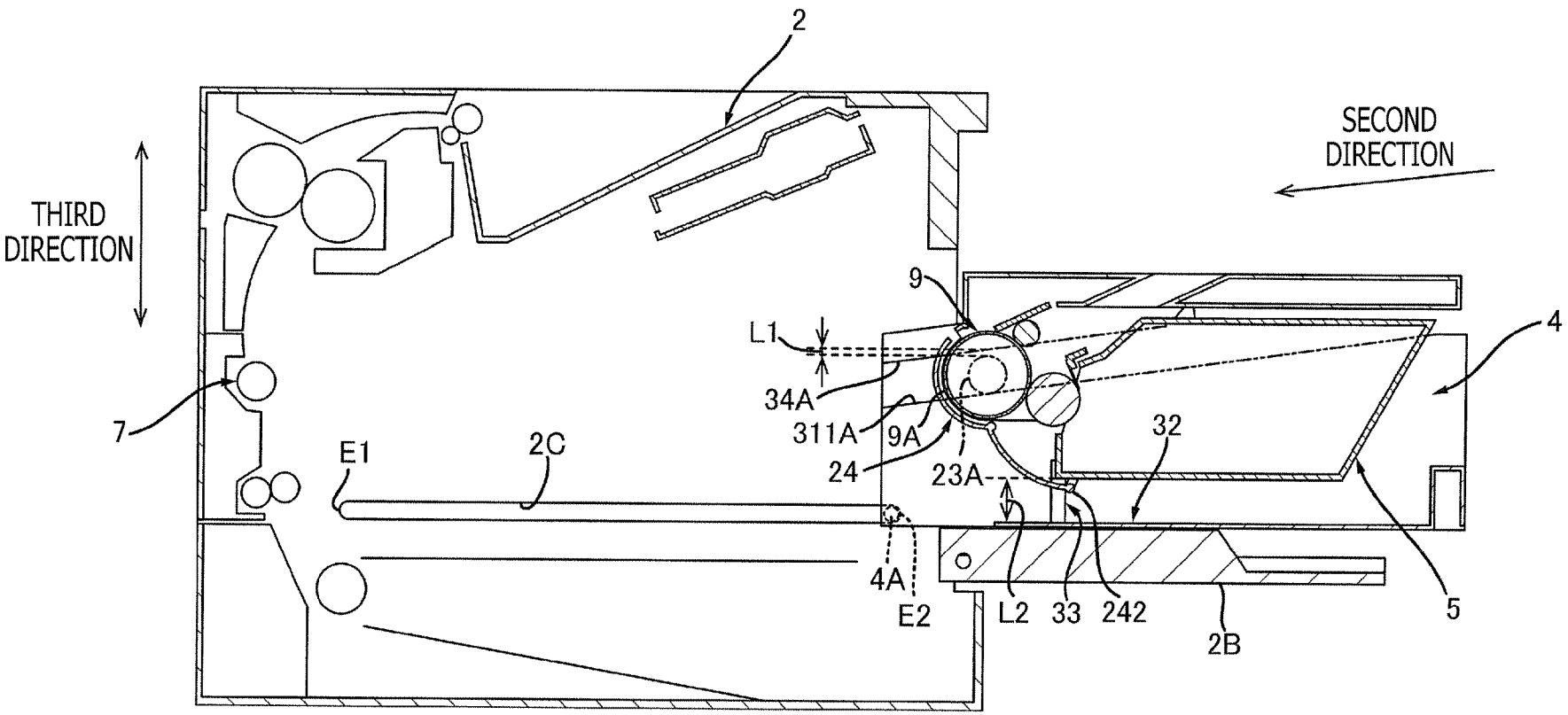
FIG. 7 is an illustrative view of the cartridge attached to the drawer with the protrusion in the drum cover contacting the contacting portion, in the state where the drum cover is located at the first position, according to the embodiment of the present disclosure.

The guide 311A may, in the state where the drawer 4 is located at the outer position, and when the cartridge 5 is being attached to the drawer 4, as shown in FIGS. 6, 7, and 2, guide the cartridge 5 in a second direction, which intersects with the first direction. Preferably, the second direction may intersect orthogonally with the first direction. The guide 311A inclines with respect to the movable direction for the drawer 4. In particular, the in the state where the drawer 4 is located at the outer position, the guide 311A inclines to be lower as the guide 311A extends toward the housing 2. Due to the inclination of the guide 311A, when a user attaches the cartridge 5 to the drawer 4, the cartridge 5 may be moved inward to slide in the housing 2 with use of the weight of the cartridge 5 mounted on the drawer 4. Therefore, the cartridge 5 may be attached to the drawer 4 smoothly.

In the state where the cartridge 5 is mounted on the drawer 4, the guide 311A may contact the guided portion 23A of the cartridge 5 from a lower position. As shown in FIG. 5, the guide 311A may be an upward surface of the first side plate 31A. Optionally, the guide 31A may be a rib formed on a side surface of the first side plate 31A.

3.2 Second Side Plate 31B

The second side plate 31B is located apart from the first side plate 31A in the first direction. The second side plate 31B includes a guide 311B. The form of the second side plate 31B may be described in the same manner as the first side plate 31A.

3.3 Bottom Plate 32

The bottom plate 32 is located between the first side plate 31A and the second side plate 31B in the first direction. The bottom plate 32 extends in the first direction. A first end being one end of the bottom plate 32 in the first direction is connected to the first side plate 31A. A second end being the other end of the bottom plate 32 in the first direction is connected to the second side plate 31B.

3.4 Contacting Portion 33

As shown in FIGS. 7 and 2, when the cartridge 5 is being attached to the drawer 4, the contacting portion 33 may contact the drum cover 24 and move the drum cover 24 from the first position to the second position. In particular, while the cartridge 5 is being guided by the guide 311A, the contacting portion 33 may contact the drum cover 24 and cause the drum cover 24 to move from the first position to the second position. While the cartridge 5 is being guided by the guide 311A, the contacting portion 33 may contact the protrusion 242 (see FIG. 3A) on the drum cover 24.

As shown in FIG. 5, the contacting portion 33 is located between the first side plate 31A and the second side plate 31B in the first direction. The contacting portion 33 may be a rib. The contacting portion 33 protrudes from the first side plate 31A. In other words, the contacting portion 33 extends from the side plate 31A. The contacting portion 33 extends in a third direction, which intersects with the first direction and with the second direction. In particular, the third direction may intersect with the first direction orthogonally and intersect with the second direction. The third direction may be, for example, the vertical direction. The contacting direction 33 is connected to the bottom plate 32. In other words, the contacting portion 33 extends from the bottom plate 32. In the state where the drawer 4 is located at the outer position, the contacting portion 33 is located outside the housing 2.

3.5 Stopper 34A

The stopper 34A is arranged on the first side plate 31A. The stopper 34A is located above and apart from the guide 311A. In other words, the stopper 34A is located apart from the guide 31A in the third direction. The stopper 24A is located on a side of the guide 31A opposite to the contacting portion 33 in the third direction. The stopper 34A extends in the second direction. Therefore, the stopper 34A extends in the direction, in which the guide 311A extends. In other words, the stopper 34A extends in parallel with the guide 311A.

When the cartridge 5 is being attached to the drawer 4, the stopper 34A may stop the cartridge 5 from separating from the guide 311A. In particular, while the cartridge 5 is being guided by the guide 311A, the stopper 34A may restrain the cartridge 5 from separating from the guide 311 in the third direction. Thus, the cartridge 5 may be guided by the guide 311A reliably, and the protrusion 242 on the drum cover 24 being in contact with the contacting portion 33 may be restrained from separating from the contacting portion 33.

As shown in FIG. 7, in the state where the cartridge 5 is being guided by the guide 311A, and further in a state where the drum cover 24 is located at the first position and where the protrusion 242 on the drum cover 24 is in contact with the contacting portion 33, the stopper 34A may face the guided portion 23A in the third direction.

In this arrangement, a distance L1 between the guided portion 23A in the cartridge 5 and the stopper 34A in the third direction is shorter than a length L2 of the contacting portion 33 in the third direction. Therefore, while the stopper 34A faces the guided portion 23A, if the cartridge 5 tends to separate from the guide 311A in the third direction, the guided portion 23A may collide with the stopper 34A before the protrusion 242 on the drum cover 24 separates from the contacting portion 33. With the guided portion 23A colliding with the stopper 34A, the cartridge 5 may stop thereat. Thus, when the cartridge 5 is being attached to the drawer 4, the protrusion 24 on the drum cover 24 may be restrained from separating from the contacting portion 33.

Meanwhile, as shown in FIGS. 7 and 2, in the state where the protrusion 242 on the drum cover 24 is in contact with the contacting portion 33, as the cartridge 5 moves in the second direction, the drum cover 24 may move with respect to the photosensitive drum 9 from the first position (see FIG. 7) toward the second position (see FIG. 2).

In the meantime, when the cartridge 5 is attached to the drawer 4, the drum cover 24 is located at the second position (see FIG. 2) with respect to the photosensitive drum 9, as shown in FIG. 2. Therefore, the part 9A of the photosensitive drum 9 may be exposed. Moreover, when the drawer 4 is located at the inner position, as shown in FIG. 1, the part 9A of the photosensitive drum 9 may contact the transfer roller 7.

3.6 Stopper 34B

The stopper 34B is arranged on the second side plate 31B. In the state where the cartridge 5 is being guided by the guide 311A, and further in the state where the drum cover 24 is located at the first position and where the protrusion 242 on the drum cover 24 is in contact with the contacting portion 33, the stopper 34B may face the guided portion 23B (see FIG. 3A) in the third direction. The form of the stopper 34B may be described in the same manner as the stopper 34A.

4. Benefits (1) According to the image forming apparatus 1 described above, in the state where the cartridge 5 is detached from the image forming apparatus 1, as shown in FIG. 3A, the drum cover 24 is located at the first position.

Therefore, in the state where the cartridge 5 is detached from the image forming apparatus 1, the photosensitive drum 9 may be protected.

Moreover, when the cartridge 5 is being attached to the drawer 4, as shown in FIG. 7, the cartridge 5 that may otherwise be detached from the guide 311A may be stopped by the stopper 34A on the drawer 4.

Therefore, the cartridge 5 may be guided by the guide 311A reliably, and the protrusion 242 on the drum cover 24 being in contact with the contacting portion 33 may be restrained from separating from the contacting portion 33.

Accordingly, when the cartridge 5 is being attached to the drawer 4, as shown in FIGS. 7 and 2, the drum cover 24 may be moved from the first position to the second position reliably.

(2) According to the image forming apparatus 1 described above, in the state where cartridge 5 is guided by the guide 311A, and further in the state where the drum cover 24 is located at the first position and where the protrusion 242 on the drum cover 24 is in contact with the contacting portion 33, the distance L1 between the cartridge 5 and the stopper 34A in the third direction is shorter than the length L2 of the contacting portion 33 in the third direction.

Therefore, in the state where the stopper 34A faces the cartridge 5, if the cartridge 5 tends to separate from the guide 311A, the cartridge 5 may be stopped by the stopper 34A before the protrusion 242 on the drum cover 24 separates from the contacting portion 33.

Accordingly, when the cartridge 5 is being attached to the drawer 4, the protrusion 242 on the drum cover 24 may be restrained from separating from the contacting portion 33.

(3) According to the image forming apparatus 1 described above, in the state where the drawer 4 is located at the outer position, and where the cartridge 5 is attached to the drawer 4, as shown in FIG. 2, the drum cover 24 is located at the second position, and the photosensitive drum 9 is located inside the housing 2.

Therefore, while the drum cover 24 is located at the second position, in which the part 9A of the photosensitive drum 9 is uncovered, the uncovered part 9A of the photosensitive drum 9 may be protected by the housing 2.

(4) According to the image forming apparatus 1 described above, in the state where the cartridge 5 is attached to the drawer 4, as shown in FIG. 2, the drum cover 24 located at the second position is located between the photosensitive drum 9 and the bottom plate 32 of the drawer 4.

Therefore, the drum cover 24 may be located at the second position by use of the space between the bottom plate 32 and the photosensitive drum 9.

Accordingly, the image forming apparatus 1 may be restrained from increasing in the size thereof.

(5) According to the image forming apparatus 1 described above, in the state where the drawer 4 is located at the outer position, as shown in FIG. 5, the guide 311A inclines downward as the guide 311A extends toward the housing 2.

Therefore, the cartridge 5 may be moved inward to slide in the housing 2 with use of the weight of the cartridge 5 mounted on the drawer 4.

Accordingly, the cartridge 5 may be attached to the drawer 4 smoothly.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

What is claimed is:

1. An image forming apparatus, comprising:

a housing;

a drawer movable between an inner position, in which the drawer is located inside the housing, and an outer position, in which the drawer is located outside the housing; and a cartridge attachable to the drawer, the cartridge comprising:

a photosensitive drum rotatable about an axis, the axis extending in a first direction; and a drum cover movable with respect to the photosensitive drum between a first position, in which the drum cover covers a part of the photosensitive drum, and a second position, in which the part of the photosensitive drum is exposed, wherein the drawer includes:

a guide configured to guide the cartridge in a second direction, when the cartridge is being attached to the drawer, the second direction intersecting with the first direction;

a stopper configured to, in a state where the cartridge is being guided by the guide, stop the cartridge from separating from the guide in a third direction, the third direction intersecting with the first direction and with the second direction; and a contacting portion configured to contact the drum cover and move the drum cover from the first position to the second position in the state where the cartridge is being guided by the guide.

2. The image forming apparatus according to claim 1, wherein the drum cover includes:

a cover body extending in the first direction; and a protrusion located at an end of the cover body in the first direction, and wherein the contacting portion is configured to contact the protrusion in the state where the cartridge is being guided by the guide.

3. The image forming apparatus according to claim 1, wherein the cartridge includes a guided portion, at which the cartridge is guided by the guide, and wherein, in the state where the cartridge is being guided by the guide, and further in a state where the drum cover is located at the first position and the drum cover is in contact with the contacting portion, the stopper is located to face the guided portion in the third direction.

4. The image forming apparatus according to claim 3, wherein the contacting portion extends in the third direction.

5. The image forming apparatus according to claim 4, wherein, in the state where the cartridge is being guided by the guide, and further in the state where the drum cover is located at the first position and the drum cover is in contact with the contacting portion, a distance between the cartridge and the stopper in the third direction is shorter than a length of the contacting portion in the third direction.

6. The image forming apparatus according to claim 1, wherein the contacting portion is a rib.

7. The image forming apparatus according to claim 1, wherein the drawer includes a first side plate and a second side plate, the second side plate being located apart from the first side plate in the first direction, and wherein the contacting portion extends from the first side plate.

8. The image forming apparatus according to claim 1, wherein the drawer includes a bottom plate, and wherein the contacting portion extends from the bottom plate.

9. The image forming apparatus according to claim 1, wherein, in a state where the drawer is located at the outer position, the contacting portion is located outside the housing.

10. The image forming apparatus according to claim 1, wherein, in a state where the drawer is located at the outer position, and further in a state where the cartridge is attached to the drawer, the drum cover is located at the second position, and the photosensitive drum is located inside the housing.

11. The image forming apparatus according to claim 1, wherein, in a state where the cartridge is attached to the drawer, the drum cover located at the second position is located below the photosensitive drum.

12. The image forming apparatus according to claim 1, wherein the drawer includes a bottom plate, and wherein, in a state where the cartridge is attached to the drawer, the drum cover located at the second position is located between the photosensitive drum and the bottom plate.

13. The image forming apparatus according to claim 1, wherein, in a state where the drawer is located at the outer position, the guide inclines to be lower as the guide extends toward the housing.

14. The image forming apparatus according to claim 1, wherein the stopper extends in a direction, in which the guide extends.

* * * * *